United States Patent [19]

Zoephel

[11] 4,040,124

[45] * Aug. 9, 1977

[54] HOSPITAL GOWN HAVING FITTING MEANS

[75] Inventor: Richard L. Zoephel, Lake Villa, Ill.

[73] Assignee: The Kendall Company, Boston, Mass.

[ * ] Notice: The portion of the term of this patent subsequent to Nov. 25, 1992, has been disclaimed.

[21] Appl. No.: 612,422

[22] Filed: Sept. 15, 1975

Related U.S. Application Data

[62] Division of Ser. No. 473,017, May 24, 1974, Pat. No. 3,921,221.

[51] Int. Cl.[2] ..... A41D 13/00

[52] U.S. Cl. ..... 2/51; 2/338

[58] Field of Search ..... 2/49 R, 50, 51, 76, 2/80, 111, 114, 211, 220, 338, DIG. 7; 156/183; 161/128

[56] References Cited

U.S. PATENT DOCUMENTS

| | | | |
|---|---|---|---|
| 2,556,931 | 6/1951 | Miller | 2/DIG. 7 |
| 2,622,246 | 12/1952 | Hufnagel | 2/49 R |
| 2,707,318 | 5/1955 | O'Donnell | 2/338 UX |
| 2,900,640 | 8/1959 | Haydu | 2/49 R |
| 3,218,649 | 11/1965 | Ricter | 2/DIG. 7 |
| 3,490,072 | 1/1970 | Keltner | 2/DIG. 7 |
| 3,574,864 | 4/1971 | Bradley | 2/114 |
| 3,639,917 | 2/1972 | Althouse | 2/DIG. 7 |
| 3,696,443 | 10/1972 | Taylor | 2/DIG. 7 |
| 3,745,587 | 7/1973 | Bradley | 2/114 |
| 3,754,284 | 8/1973 | Hartigan et al. | 2/DIG. 7 |
| 3,803,640 | 4/1974 | Ericson | 2/114 |
| 3,824,625 | 7/1974 | Green | 2/114 |
| 3,921,221 | 11/1975 | Zoephel | 2/51 |

*Primary Examiner*—Werner H. Schroeder
*Assistant Examiner*—Moshe I. Cohen
*Attorney, Agent, or Firm*—Powell L. Sprunger

[57] ABSTRACT

A hospital gown has portions thereof encircling a wearer's body which bear a cohesive-adhesive material to enable an adjustably snug fit.

2 Claims, 11 Drawing Figures

FIG. 1
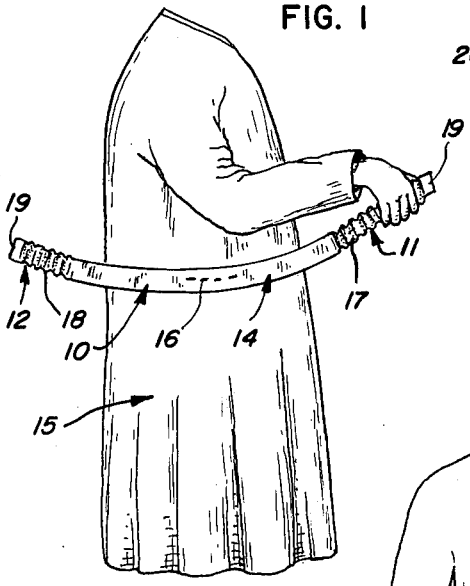
FIG. 2
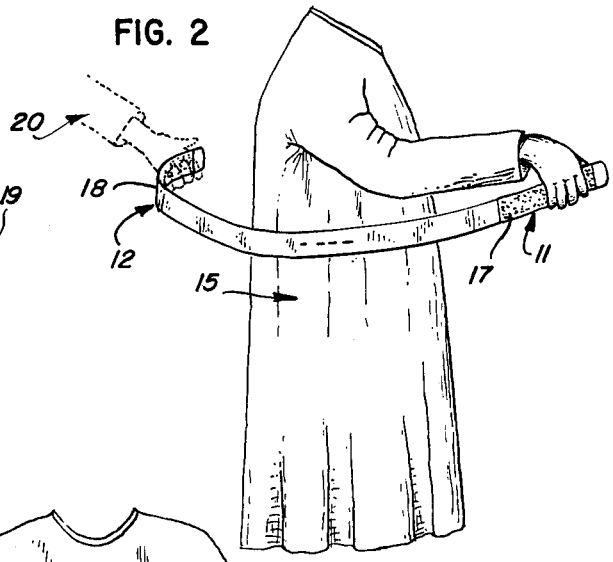
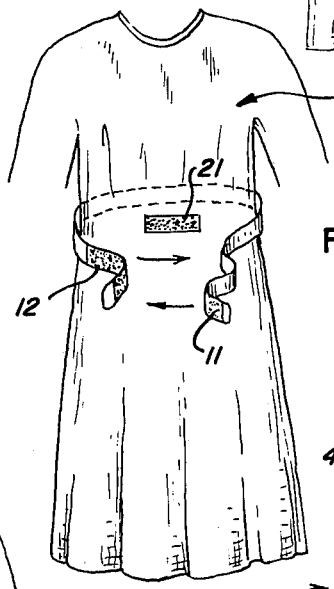
FIG. 3
FIG. 4
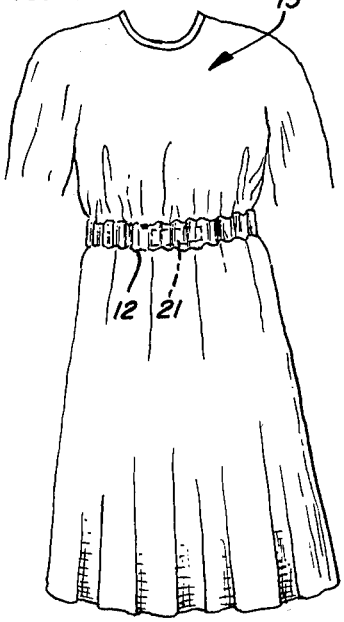
FIG. 5
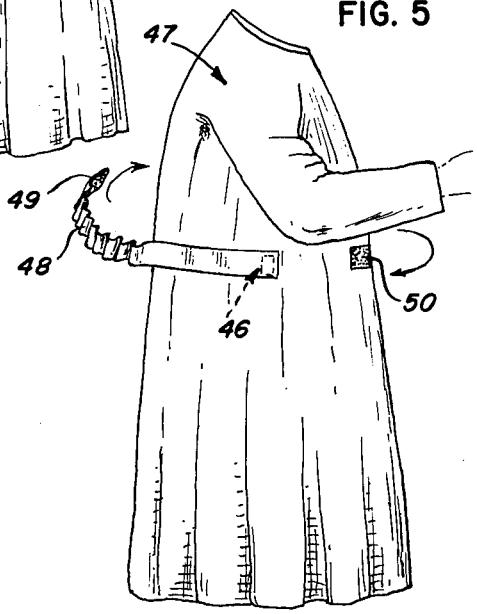

FIG. 6
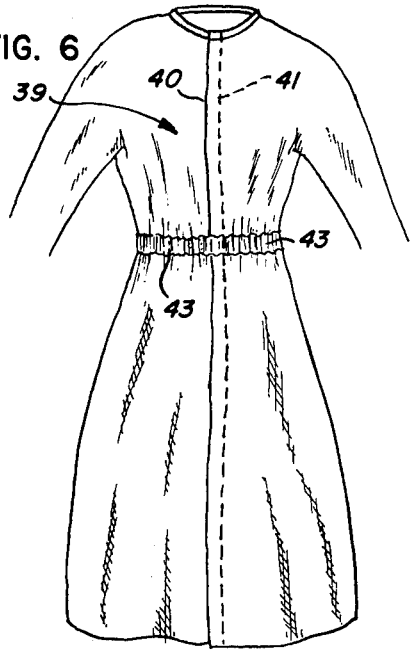
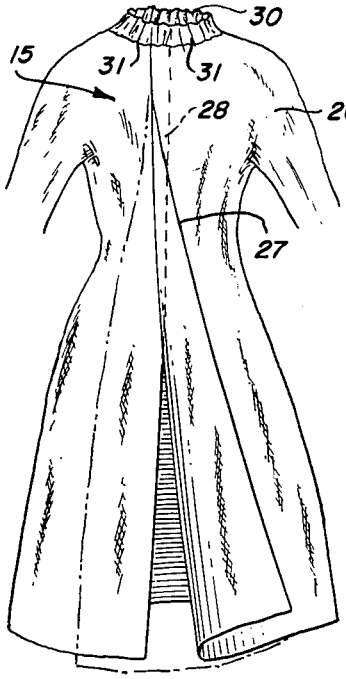
FIG. 7
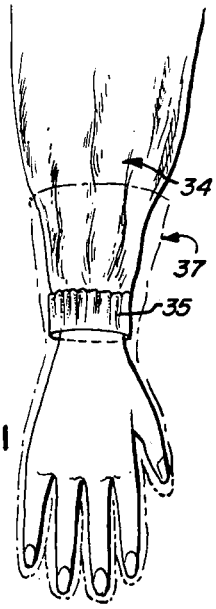
FIG. 11
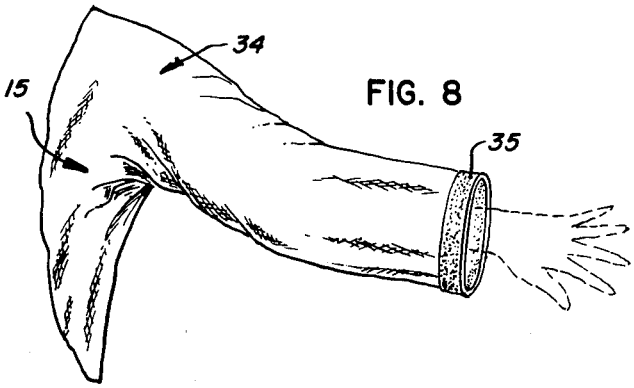
FIG. 8
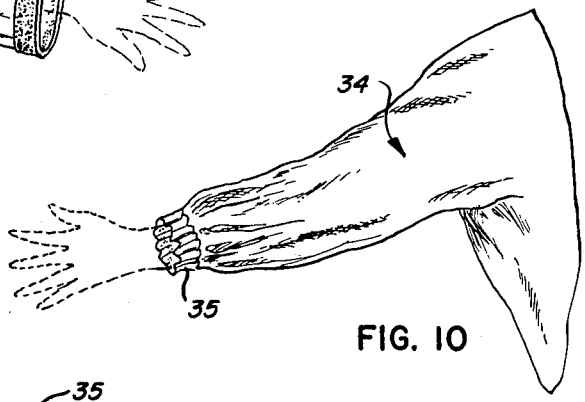
FIG. 10
FIG. 9
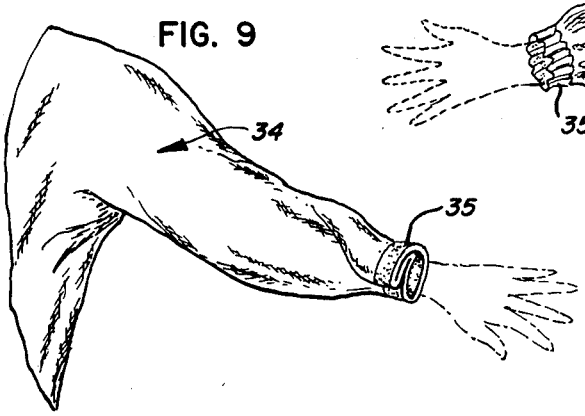

HOSPITAL GOWN HAVING FITTING MEANS

This is a division of application Ser. No. 473,017 filed May 24, 1974, now U.S. Pat. No. 3,921,221.

BACKGROUND OF THE INVENTION

Surgical or obstetrical procedures present problems to doctors and other hospital personnel because of the requirement that aseptic conditions be maintained prior to and throughout the procedures. One constant problem has been the aseptic gowning of doctors and nurses in preparation for a surgical procedure. In this regard, the problem of closing or fitting the gown has been troublesome. Another current problem is the availability of an isolation gown for hospital use that is inexpensive, disposable and easily put on and adjustably fitted to the wearer.

Normally, a doctor dons a back-closing operating room gown by putting his hands and arms into the sleeves thereof and the gown is pulled up around his body so that it will close in back. Usually some type of fastening means holds the gown closed near the back of the wearer's neck. This has sometimes been a tie strip sewn or otherwise fastened, as by taping, for example, to each neck edge of the gown, with an extended length for tying for comfortable fit. These tie strings hang free and may touch a non-sterile area and become contaminated. They also may require an assistant to secure. A velcro strip has been employed on facing edges of the neck opening. The wearer then presses the velcro portions together for a good fit. There is less danger of contamination with a strip of velcro but the cost is often prohibitive, especially in the case of disposable gowns.

Provision is also made to close the main body portion of the gown around the wearer's body at waist level. This controls the gown material, preventing it from flapping into the zone of operation, bunching, or otherwise interfering with the wearer or persons around the wearer. Traditionally both in surgical gowns and isolation gowns some sort of belt has been employed for this purpose. The belt extends around to the back of the wearer and consequently, if aseptic conditions are to be maintained, an assistant applies the belt around the doctor or other wearer's body. Belts unattached to the gown have been utilized in the past. This requires the handling of two separate items, the gown and the belt, and increases the problem of maintaning aseptic conditions due to the relative ease of accidentally dropping the belt during the belting procedure, etc. More recently a belt folded a plurality of times or roller throughout a portion between its two ends and positioned within a housing or casing-like holder of the gown has been used. See for example, Hartigan, U.S. Pat. No. 3,648,290. While eminently more desirable than a separate belt, the Hartigan type of belt requires that some sort of housing arrangement be provided to avoid having the belt unfold or unroll and flap about, thereby causing a possible contamination problem. There is, of course, additional cost in manufacturing and applying this type of belt.

A further area where a close fit in hospital gowns is desired, or required for maintenance of sterile conditions, is the cuff area. A doctor puts on surgical gloves which must fit snugly over the sleeve of the gown. For aseptic purposes the sleeves must not slip out of the gloves. To this end, most operating room gowns have a stockinette type cuff stitched to the lower portion of the sleeve for gathering the material and forming a snug-fitting wrist portion. Any manufacturing procedure whereby a separate piece is stitched on a gown adds to the cost of the gown, and this obviously is a disadvantage of the stockinette type cuff.

BRIEF SUMMARY OF THE INVENTION

The present invention provides an improved means for adjustably fitting areas of hospital gowns, especially operating room gowns. Briefly, the invention utilizes woven or nonwoven portions of elastic or inelastic fabric coated or impregnated with, or otherwise bearing, a cohesive-adhesive material which has affinity only to itself. By a cohesive-adhesive material I mean a material which, after being attached to a surface or substrate, has affinity only for itself and consequently has little or no tack for surfaces other than those similar to itself. Examples of such materials are crepe rubber and latex rubber. Generally, cohesive-adhesive suitable for use include aqueous emulsions or solvent solutions of rubber base adhesives, natural or synthetic. Certain acrylic base pressure sensitive adhesives can also be used, provided they are capable of adhering to or have an affinity for bonding only to themselves. The cohesive-adhesive material may be brushed on, or the fabric submerged in a bath of the cohesive-adhesive material and thereafter pressed through rollers and dried. Other methods of incorporating the material into or on the fabric may be utilized. With puling pressure over and above the stress which would be put upon a hospital gown in normal usage, surfaces bearing cohesive-adhesive which have cohered together can be released and thereafter re-cohered.

By the use of my invention closure and close fitting of all areas desired to be adjustably fitted on a hospital gown can be achieved quickly, easily, inexpensively and without danger of contamination. No additional pieces need be stitched to the gown.

The areas which encircle parts of a wear's body and which have a plurality of portions bearing cohesive-adhesive material may be integral with the material of which the gown is constructed. Alternatively, strips bearing the cohesive-adhesive material can be affixed to the areas of the gown where closure and fitting is desired as by taping, etc. Any woven or nonwoven fabric recognized in the art as appropriate for the manufacture of operating room gowns or drapes, e.g. paper, plastic, cotton fabrics, nonwoven reinforced fabrics, etc. can be treated to have the cohesive-adhesive material in the area desired. If strips are used, it is not required that they be of the same construction material as the remainder of the gown so long as they are securely affixed thereto.

An important feature of my invention is that the cohesive-adhesive material is elongated in the direction of encirclement of the portion of the body required to be fitted. Thus, when a wrist is being fitted, the direction of elongation is circumferentially of the wrist; when the waist is being fitted, the direction of elongation is circumferentially of the waist; etc. By "elongation" I mean to say, and my invention requires, that the width of the surfaces bearing the cohesive-adhesive, in the direction of encirclement of a portion of a wearer's body, is at least several times the width that would be required merely to affix two portions of the gown area to each other at the margins. This is an absolute requisite in order to be able to obtain the result of adjustably fitting to the wear's body as discussed herein. Generally the width of the surfaces bearing the cohesive-adhesive will be at least about one-fifth of the distance encircled by the area of the gown containing the surface.

DESCRIPTION OF THE DRAWINGS

FIG. 1 is a side elevational view of a gown having one embodiment of the waist fitting means of the invention, showing the crimped or pleated end portions and a preferred attachment;

FIG. 2 is a fragmentary view similar to FIG. 1 and showing the end portions of the waist fitting means of FIG. 1 pulled out in an extended position to enable the wearer to encircle the waist therewith;

FIGS. 3 and 4 are front elevational views illustrating the sequence of steps in closing the waist area of a gown in accordance with the embodiment shown in FIG. 1;

FIG. 5 is a side elevational view of a gown showing an alternative form of waist fitting means of the invention;

FIG. 6 is a ear elevational view of another alternative waist fitting means of the invention;

FIG. 7 is a rear elevational view of the embodiment of the invention showing the adjustable neck closure;

FIG. 8 shows a portion of a gown, including the lower sleeve portion and arm of the wearer, and showing the wrist snugging means of the invention;

FIG. 9 is a fragmentary view of the sleeve and shows one embodiment of the wrist snugging means of FIG. 8 prior to placement of a wearer's gloves;

FIG. 10 is a fragmentary view of the sleeve end showing another embodiment of the wrist snugging means of FIG. 8 prior to placement of a wearer's gloves; and FIG. 11 is a view, partially broken away, of the embodiment of FIG. 10, with the glove on the wearer.

DETAILED DESCRIPTION

In utilizing my invention the waist closure area may comprise an elastic or inelastic belt, or strip, of woven or nonwoven material sufficiently long to fit about the midsection of a wearer, with ample length to spare for ease of fit around various-sized wearers. A plurality of portions thereon defining surfaces, or all of the belt carry a cohesive-adhesive material, such as crepe rubber. From a production standpoint it is most often desirable to coat or impregnate the entire length of the belt or strip. However, for the purposes of my invention, it is sufficient if the end portions of the belt or strip are treated to bear the cohesive-adhesive at least on facing portions when overlapped. The end portions should constitute at least about one-fifth of the length of the belt or strip. A portion of the strip is securely attached to the gown to make it integral therewith. This attachment is at about waist level on the gown and intermediate the end portions. A convenient point for attachment in this instance is at the side area of the gown. A half-belt can be used having only one end portion for pulling around a wearer's waist, with that end portion bearing cohesive-adhesive on at least the inside face thereof. In that instance the other end of the half-belt is firmly attached to the gown to make it integral therewith. This attachment can be at any convenient area on the gown, at about waist level, so long as the attachment is on the overlapping margin of the gown.

The end portions of the belt (or portion if a half-belt is used) are then folded back upon themselves and pressed together, or gathered together and pleated or crimped by means of the portions bearing cohesive-adhesive being brought into contact with each other to form a cohesive bond. The belt length is thereby decreased sufficiently that the ends do not hand down much below about waist level when the gown is picked up by a wearer for donning purposes. When used, the wearer pulls out only so much of the excess circumferential material of the strip as is required for a close fit and coheres the strip as by bringing the end portions or lengths into cohering contact. The remainder of the strip, if any, remains pressed or gathered together, thereby maintaining the close fit.

For ease of use by the wearer, the tip end portion at any free end of the strip may be constructed and positioned that the wearer has no trouble picking up the end and pulling the folded or gathered portion of the belt to its extended or partially extended position for fitting around the area of the wearer's body being encircled. For example, this tip end portion maybe completely free of cohesive-adhesive, may have a tab-like cover portion placed thereover and removable if desired, or may be folded back upon itself slightly to form a tab for pulling.

Alternatively, the area encircling a gown wearer's waist in a gown which is longitudinally closable by a first marginal portion overlapping a second marginal portion may have a plurality of portions bearing cohesive-adhesive that extend circumferentially from the first marginal opening or portion of the gown to the second marginal opening or portion of the gown sufficiently so that when pressed together into cohering contact the area encircling the waist is closely fitted to the wearer's waist. The portions may be cohered to some predetermined degree prior to the wearer donning the gown. In this instance the putting on of the gown may release some of the plurality of portions of coherence sufficiently to fit about the wearer without releasing the remainder of the portions. The wearer and/or an assistant can then re-cohere certain of the plurality of portions to provide a close fit which will remain so fitted until it is desired that the fit be released.

To make sure the back margin of the gown is closed at about the waist area, the portions bearing cohesive-adhesive may be on both sides of the gown at at least the margin areas or, alternatively, a marginal edge may be folded over sufficiently to insure a closure when the portions are pressed together into cohering contact.

In the usual gowning procedure for operating room use, when a belt or strip is used, a ready-to-wear sterile gown is put about a wearer, probably a doctor. For closely fitting the gown about the wearer's midsection the wearer, and an assistant, grasp the end or ends of the belt and pull thereon, causing the folds or pleats to open or extend. Once both ends of the belt have been pulled out to the proper length for snugly fitting around the wearer, the ends may be secured by overlapping them and firmly pressing them together to form a cohesive bond. In this embodiment it is feasible that a portion of the gown generally under the area of the belt or strip bear cohesive-adhesive so that the strip may be cohered thereto for added stability of fit if desired. When a half-belt is used the end is pulled around the back opening and snugly fitted around the wearer. The portions of the belt bearing cohesive-adhesive are then brought into cohering contact with an area of the gown generally under the area of the belt, which area of the gown also bears cohesive-adhesive.

This means for fitting the gown about the midsection of a wearer allows the wearer to gown significantly faster since the tieing operation is not involved. It also provides better technique since there are no loose ends sticking out as a possible source for contamination. From a manufacturing standpoint it may be less expensive to produce than a tunnel or casing arrangement for keeping the belt ends from flapping down when the gown is put on. Furthermore, it is feasible for the wearer of a hospital gown to handle the waist encirclement fitting by himself when utilizing embodiments of this invention and dispense with the use of an assistant. If a nonsterile assistant aids in the positioning of the area to be fitted to adjustably decrease its size, it may be desirable that the end-most portions of the belt be covered by a removable piece or tab so that sterile conditions are maintained.

The area encircling the wearer's neck also has a plurality of portions bearing cohesive-adhesive that extend circumferentially sufficiently from the first marginal opening or portion of the gown and the second marginal opening or portion to provide an adjustable fit around the wearer's neck. The entire circumference of the neck of the gown may bear cohesive-adhesive if desired. When pressed together into cohering contact, the area encircling the neck is closely fitted to the wearer's neck. To make sure the back margin is closed at about the neck area, the portions bearing cohesive-adhesive may be on both sides of the gown at at least the margin areas (i.e. facing edges), or, alternatively, a marginal edge may be folded over sufficiently to ensure a closure when the portions are pressed together into cohering contact.

It is also contemplated that the wrist or cuff area of the gown carrying the cohesive-adhesive material at the lower arm, or sleeve edge. This eliminates the necessity for stitching on or otherwise affixing the conventional stockinette cuff. A plurality of portions in the area of the sleeve which encircle the wrist carry a cohesive-adhesive material on a surface thereof substantially continuously around the wrist in the direction of the encirclement. The lower end of the sleeve can thereby be gathered or pulled in to adjustably decrease its size in said direction by cohering said portions. The sleeve end may be partially decreased in size in this manner before the wearer dons the gown. After the gown is placed on, it may be desired to more snugly fit the wrist, or cuff portion. This is readily accomplished by firmly grasping the wrist portion of the gown and crimping it together around the wrist to bring the portions which carry cohesive-adhesive into cohering contact. The wrist portion will thereafter remain crimped, or gathered, with no likelihood of pulling apart in normal use.

Referring now to the drawings, the embodiment of FIG. 1 shows a flexible belt, or strip, generally 10, having a first end portion, generally 11, a second end portion generally 12, and an intermediate portion, generally 14. Belt 10 is integral with a gown, generally 15 by being secured thereto as for example at 16. The attachment 16 to make belt 10 integral may be any conventional means, such as stitching, taping, etc. Portions 17 and 18 of end portions 11 and 12, respectively, are shown crimped or gathered to reduce the length of belt 10 sufficiently to prevent the ends from falling much below about waist level at the point in the gowning procedure when the wearer first dons the gown. In this embodiment end portions generally 11 and 12 bear cohesive-adhesive, which is identified in the drawings by the shading.

Turning now to FIG. 2, end portion generally 11 is shown grasped by the wearer and crimped portion 17 is extended to the desired length. End portion generally 12 is shown grasped by an assistant, generally 20, with crimped portion 18 being extended to its desired length. As is shown in FIG. 1, end portions 11 and 12 may have tab 19 which can be removably secured to the end portions or integral therewith, so as to make an easily graspable portion of the belt. Preferably this tab is not pressed back against the portion of the belt containing the cohesive-adhesive material or does not itself contain the cohesive-adhesive material.

While it is common that an assistant aids a doctor in donning a surgical gown, it is feasible with my invention that a wearer dispense with the services of an assistant in this procedure and alone pull both end portions 11 and 12 to their extended FIG. 2 position. Thus my invention allows the same gown to be usable both as an operating room gown and an isolation gown, with the obvious advantages thereof. FIG. 3 shows the wearer with the belt end portions 11 and 12 snugly pulled around the midsection and ready to be closed, or fastened, in place. FIG. 4 shows the belt ends fastened by means of pressing the ends together whereby the cohesive-adhesive material is removably secured to the other cohesive-adhesive bearing portions of the belt to form a firm, yet removable, bond and thereby a snug fit. There are no loose ends to cause a possible contamination problem. In one embodiment (see FIGS. 3 and 4) a portion 21 of gown 15, which portion will be generally under belt 10 at about the waist level, may also bear cohesive adhesive to aid in fitting the gown and keeping the belt at waist level.

FIG. 5 shows a half-belt generally 46 attached to a portion of a gown generally 47 at about waist level and on an overlapping margin. Belt end portion 48 is crimped or gathered to substantially reduce its length. The wearer or an assistant grasps the tab portion 49 to extend portion 48 sufficiently to snugly fit gown 47 about the wearer. The gown has a waist portion 50, in the front thereof at about waist level, containing cohesive-adhesive. End portion 48 is brought into cohesive contact with portion 50 to provide a close fitting gown.

FIG. 6 shows an alternative embodiment of the waist-fitting procedure of my invention. In this embodiment gown generally 39 has a longitudinal back closing with overlapping margins 40 and 41 arranged to have one overlap the other, and bears cohesive-adhesive material on a plurality of portions, generally 43, elongated around the circumferential area of the gown at about the waist area, including the margins. The portions are brought into cohering to close the gown at the back and reduce the circumference of the gown at about the waist to closely fit the wearer.

Referring now FIG. 7, back 26 of gown 15 has a first margin 27 and a second margin 28 which is overlapped by margin 27 when the gown is worn. FIG. 7 shows no belt in place. Any waist fitting means may be used, preferably those shown and described herein. Neck area 30 of gown 15 has a plurality of portions, generally 31, elongated around the circumferential area of the gown at the neck area. The portions are brought into cohering contact to close the neck margins and reduce the circumference of gown at the neck area. Both sides of the gown material at neck area 30 may bear cohesive-adhesive. Alternatively margins 27 or 28 may be folded back upon itself to provide a coherent surface.

Referring now to FIGS. 8 through 11, gown 15 has sleeves, one of which is illustrated here as generally 34, having a lower edge portion 35 of sufficiently larger circumference than a wearer's wrist that the hand and arm easily inserted therethrough. This lower edge portion 35 is coated or impregnated with or otherwise bears a cohesive-adhesive on a plurality of portions 36 elongated around the circumferential area of the sleeve 34 at about the wrist area. FIG. 9 shows one means of decreasing the circumference of the lower edge portion 35, as by pulling the lower edge snugly about the wrist area and pressing the opposing portions of the remainder of edge portion 35 together to cohere them. FIG. 10 illustrates another way of fitting the lower edge about the wrist of the wearer, i.e. to achieve a gathered effect at the cuff edge 35. This effect is achieved by bunching the portions of the lower sleeve of the gown and pressing them together whereby to cohere the surfaces containing the cohesive-adhesive. FIG. 11 shows a gloved hand with edge portion 35 snugly fitting around the wearer's wrist underneath glove, generally 37.

The foregoing disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

I claim:

1. A hospital gown comprising, a garment having a front, a back, and first and second margins defining an opening for placement of the garment on a wearer, a belt having first and second ends and having a sufficient length to encircle the garment, and a cohesive-adhesive material on both of said belt ends for releasably attaching the belt ends together with said belt passing around the garment margins to close the garment about the wearer, at least one of said belt ends having cohesive-adhesive material on both of its opposed sides, said garment including a region of cohesive-adhesive material on the outside of the gown and located to releasably attach at least one of said belt ends to the gown when said belt closes the garment.

2. The gown of claim 1 wherein said margins are located on the back of the gown.

* * * * *

UNITED STATES PATENT AND TRADEMARK OFFICE

CERTIFICATE OF CORRECTION

PATENT NO. : 4,040,124

DATED : August 9, 1977

INVENTOR(S) : Richard L. Zoephel

It is certified that error appears in the above-identified patent and that said Letters Patent are hereby corrected as shown below:

Column 1, line 29, "velcro" should be -- Velcro -- .

Column 1, line 30, "velcro" should be -- Velcro -- .

Column 1, line 32, "velcro" should be -- Velcro -- .

Column 1, line 50, "roller" should be -- rolled -- .

Column 2, line 38, "wear's" should be -- wearer's -- .

Column 2, line 67, "wear's" should be -- wearer's -- .

Column 3, line 19, "ear" should be -- rear -- .

Column 5, line 31, "carrying" should be -- carry -- .

Column 7, line 1, after "arm" insert -- are -- .

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*